US012680423B2

(12) United States Patent
Sundqvist et al.

(10) Patent No.: US 12,680,423 B2
(45) Date of Patent: Jul. 14, 2026

(54) GUIDE ROD

(71) Applicant: TECHNIPFMC NORGE AS, Kongsberg (NO)

(72) Inventors: Gøran Sundqvist, Kongsberg (NO); Lasse Mold-Estad, Kongsberg (NO)

(73) Assignee: TechnipFMC Norge AS, Kongsberg (NO)

( * ) Notice: Subject to any disclaimer, the term of this patent is extended or adjusted under 35 U.S.C. 154(b) by 0 days.

(21) Appl. No.: 18/874,965

(22) PCT Filed: Jun. 1, 2023

(86) PCT No.: PCT/EP2023/064694

§ 371 (c)(1),
(2) Date: Dec. 13, 2024

(87) PCT Pub. No.: WO2023/241934

PCT Pub. Date: Dec. 21, 2023

(65) Prior Publication Data

US 2025/0354462 A1 Nov. 20, 2025

(51) Int. Cl.

| | |
|---|---|
| ***E21B 41/10*** | (2006.01) |
| ***E21B 41/00*** | (2006.01) |
| ***F16B 17/00*** | (2006.01) |

(52) U.S. Cl.
CPC ..... *E21B 41/10* (2013.01)

(58) Field of Classification Search
CPC ..... E21B 41/00; E21B 33/038; F16B 17/00; B63B 21/00; B63B 21/50
(Continued)

(56) References Cited

U.S. PATENT DOCUMENTS 3,108,637 A * 10/1963 Lee ..... E21B 23/06 294/86.25
3,628,988 A * 12/1971 Stol ..... A61C 13/0025 264/16

(Continued)

FOREIGN PATENT DOCUMENTS

GB 2085990 A 5/1982

OTHER PUBLICATIONS

International Search Report and Written Opinion for Application No. PCT/EP2023/064694, dated Aug. 3, 2023.

*Primary Examiner* — Nicole Coy
*Assistant Examiner* — Douglas S Wood
(74) *Attorney, Agent, or Firm* — Kevin E. West; Advent, LLP

(57) ABSTRACT

A guide rod for guiding two subsea components together. The guide rod comprises a hollow and cylindrical element being and comprising a first circumferential shoulder towards a first end, a second circumferential shoulder towards an opposite second end, and a plurality of openings extending radially through the element and axially along the element, the plurality of openings forming elongate flexible sections of the element, and extending through the first circumferential shoulder; a wedge inside the element comprises a cone shaped section, the wedge restricted from rotating relative to the element and comprising an end being outside of the element; a cone connected to the end of the wedge and cone shaped with a vertex pointing away from the element; and a mechanism for moving the wedge axially relative to the element in an insertion direction, and opposite the insertion direction, of the guide rod.

19 Claims, 4 Drawing Sheets

(58) Field of Classification Search
USPC ..... 166/341
See application file for complete search history.

(56) References Cited

U.S. PATENT DOCUMENTS

| | | | | | |
|---|---|---|---|---|---|
| 3,741,601 | A * | 6/1973 | Dudley | E21B 31/18 | 294/86.18 |
| 4,236,967 | A * | 12/1980 | Batjukov | G21C 19/105 | 294/906 |
| 4,359,960 | A * | 11/1982 | Burchett | E21B 41/10 | 114/294 |
| 4,386,659 | A | 6/1983 | Shotbolt | | |
| 4,919,881 | A * | 4/1990 | Hankinson | G21C 19/02 | 976/DIG. 251 |
| 5,242,201 | A * | 9/1993 | Beeman | E21B 31/18 | 294/86.15 |
| 5,259,459 | A | 11/1993 | Valka | | |
| 9,637,992 | B2 * | 5/2017 | Thomas | E21B 31/20 | |
| 2018/0034280 | A1 * | 2/2018 | Pedersen | E21B 41/00 | |

* cited by examiner

GUIDE ROD

TECHNICAL FIELD

The present disclosure relates to a guide rod and a combination of the guide rod and a receptacle. More particularly, the present disclosure relates to a guide rod, for guiding two subsea components together, the guide rod being able to be both inserted and locked into a receptacle on one of the two subsea components. The guide rod, being locked onto a receptacle on one of the two subsea components, may be used for guiding the other subsea component in relation to the subsea component.

BACKGROUND

Guide rods are used for guiding one subsea component relative to another subsea component. For example, guide rods may be used for installing a blow out preventer (BOP) onto the wellhead. The guide rods are attached to the subsea component, for example a foundation for the wellhead, by being inserted and locked into receptacles on the subsea component.

One problem is how to lock the guide rod into the receptacle. The guide rod should be able to take up large forces. Locking the guide rod into the receptacle on a subsea component must allow the guide rod to withstand very large forces, sometimes up to several hundred tons. The guide rod, and the locking of the guide rod, should be able to take up at least some of the forces, that normally would go through the wellhead, out into a foundation structure.

A further problem is that any guide rod should be able to work with existing systems. A guide rod should be able to connect to different well equipment. A guide rod must be suitable for remote operation subsea, and must be suitable for guiding subsea components.

It is also desirable to provide a guide rod that is inexpensive to manufacture, is easy to manufacture and assemble, and is robust and reliable. The guide rod should also be able to provide a good and reliable operation of being locked into the receptacle and for subsequent installation of subsea components.

The present disclosure is directed to overcoming one or more of the problems as set forth above.

SUMMARY

The present disclosure is directed to a guide rod and a combination of the guide rod with the receptacle.

According to one embodiment, a guide rod, for guiding two subsea components together, is disclosed. The guide rod is able to be both inserted and locked into a receptacle on one of the two subsea components. The guide rod comprises an element, a wedge, a cone, and a mechanism for moving the wedge. The element being substantially hollow and cylindrical, the element comprising a first circumferential shoulder towards a first end, a second circumferential shoulder towards an opposite second end, and a plurality of openings, each opening extending radially through the element and extending axially along the element opening up the element from the first end to, and including, the second circumferential shoulder, the plurality of openings forming elongate flexible sections of the element, and extending through the first circumferential shoulder. The wedge is inside the element and substantially cylindrical and comprising a cone shaped section, the wedge is restricted from rotating relative to the element and comprising an end being outside of the element. The cone is connected to the end of the wedge, and the cone is cone shaped with a vertex pointing away from the element. The mechanism is for moving the wedge axially relative to the element in an insertion direction, and opposite the insertion direction, of the guide rod.

According to one embodiment, the mechanism is configured to move the wedge in the insertion direction and thereby move the cone in the insertion direction and at the same time move the elongate flexible sections outward with the wedge. In embodiments, the mechanism is configured to move the wedge opposite the insertion direction and thereby move the cone towards and over at least a part of the elongate flexible sections thereby forcing the elongate flexible sections inwards and at the same time move the wedge to allow the elongate flexible sections to move inwards.

According to one embodiment, the element is configured to have no internal stress when the elongate flexible sections have been moved to their outmost position with the wedge.

According to one embodiment, the element comprises an inner cone shaped surface, an outer cone shaped surface, and an inner straight section. In embodiments, the outer cone shaped surface is at the first end of the element facing the direction of insertion. In embodiments, the inner straight section is towards the second end of the element. In embodiments, the inner cone shaped surface, viewed in the axial direction, is between the outer cone shaped surface and the inner straight section.

According to one embodiment, the first circumferential shoulder comprises a first truncated cone shaped surface. In a further embodiment, the second circumferential shoulder comprises a second truncated cone shaped surface, the first truncated cone shaped surface and the second truncated cone shaped surface facing each other.

According to one embodiment, the cone comprises a hollow space for at least a part of the elongate flexible sections of the element. In embodiments, the cone comprises an inner cone shaped surface that is always around at least a part of the elongate flexible sections to allow the inner cone shaped surface to force the elongate flexible sections together in the hollow space. In embodiments, a base of the cone has a diameter that is smaller than a largest diameter of the element.

According to one embodiment, the mechanism comprises an internal thread interacting with an external thread on, or connected to, the wedge.

According to one embodiment, the wedge comprises a straight section, a middle section, the cone shaped section, and an end section. In embodiments, a diameter of the straight section is constant and is larger than a diameter of the middle section. In embodiments, the diameter of the middle section is larger than a diameter of the end section. In embodiments, the cone shaped section has a base diameter that corresponds to the diameter of the middle section and a vertex diameter that corresponds to the diameter of the end section. In embodiments, the end section comprises the end of the wedge.

According to one embodiment, the plurality of openings extend axially along the element from the first end, through the first circumferential shoulder, through the second circumferential shoulder, and beyond the second circumferential shoulder.

According to one embodiment, a cover is arranged on the cone to prevent debris from entering into the cone.

According to one embodiment, the guide rod further comprises an elongate guiding member, the guiding member being hollow with a drive shaft inside for the mechanism and the guide member being part of, or axially connected to, the element.

According to one embodiment, a combination of the guide rod according to any one of the preceding embodiments and the receptacle on one of the two subsea components is disclosed. The receptacle comprises a substantially hollow cylinder with a first circumferential shoulder of the receptacle and a second circumferential shoulder of the receptacle. In embodiments, the first circumferential shoulder of the receptacle and the second circumferential shoulder of the receptacle is complementary in shape to engage the first circumferential shoulder and the second circumferential shoulder, respectively. In embodiments, an inner diameter of the hollow cylinder is smaller than an outer diameter of the second circumferential shoulder.

According to one embodiment, the hollow cylinder, the first circumferential shoulder of the receptacle, and the second circumferential shoulder of the receptacle is fitted in form to the element with the first circumferential shoulder and the second circumferential shoulder.

According to one embodiment, the combination is configured such that when the guide rod is locked in the receptacle then there is no clearance between the two.

According to one embodiment, the combination is configured such that when the guide rod is locked in the receptacle then the element and the receptacle are free from stress from each other due to the locking.

One or more embodiments disclosed herein provide a guide rod that locks the guide rod into the receptacle. The guide rod according to one or more embodiments is able to take up large forces, and does not by the locking of the guide rod to the structure create, transmit, large forces onto the subsea component on which it is placed when the guide rod is locked into the receptacle on the subsea component. There may be some forces by the locking of the guide rod as it may be positioned with some tension to prevent slack in the connection. One or more embodiments disclosed herein provide a guide rod that is able to take up forces that normally would go through the wellhead. Hereby forces would go through from the guide rod, via the locking system according to the embodiments disclosed herein, to the subsea structure, for example, the foundation and into the ground and not affect the wellhead. This would allow the BOP to lock onto the guide rods, and therethrough have the possibility to limit the forces on the wellhead and rather have the forces taken up by the guide rods to the foundation structure. This would require the BOP to lock onto the guide rod, and such a solution is not part of this disclosure.

At least one embodiment provides a guide rod that connects to different well equipment, is suitable for remote operation subsea, and is suitable for guiding subsea components. At least one embodiment provides a guide rod that is inexpensive to manufacture, is easy to manufacture and assemble, and is robust and reliable. The guide rod according to one or more embodiments provides a good and reliable operation of being locked into the receptacle and for subsequent installation of subsea components.

At least one of the above embodiments provides one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any embodiment disclosed herein may be technically combined with any other embodiment(s) disclosed herein.

BRIEF DESCRIPTION OF THE DRAWINGS

The accompanying drawings illustrate presently exemplary embodiments of the disclosure, and together with the general description given above and the detailed description of the embodiments given below, serve to explain, by way of example, the principles of the disclosure.

DETAILED DESCRIPTION

Figure 1:
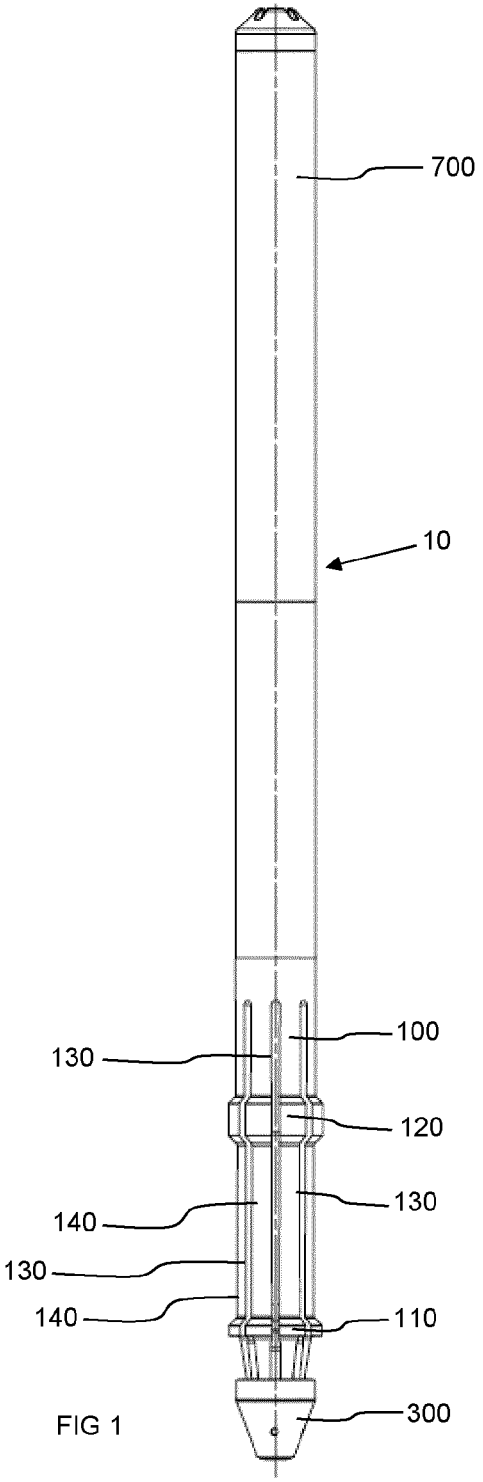
FIG. 1 is a diagrammatic illustration of an exemplary embodiment of a guide rod in an expanded state.
Figure 2:
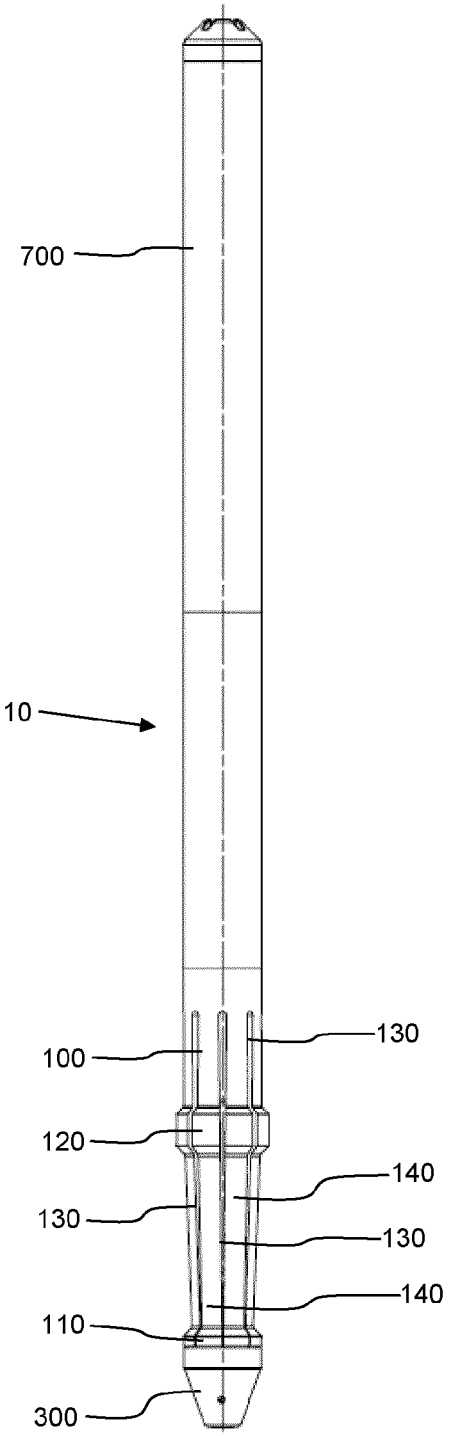
FIG. 2 is a diagrammatic illustration of the guide rod of FIG. 1 in a contracted state.
Figure 3:
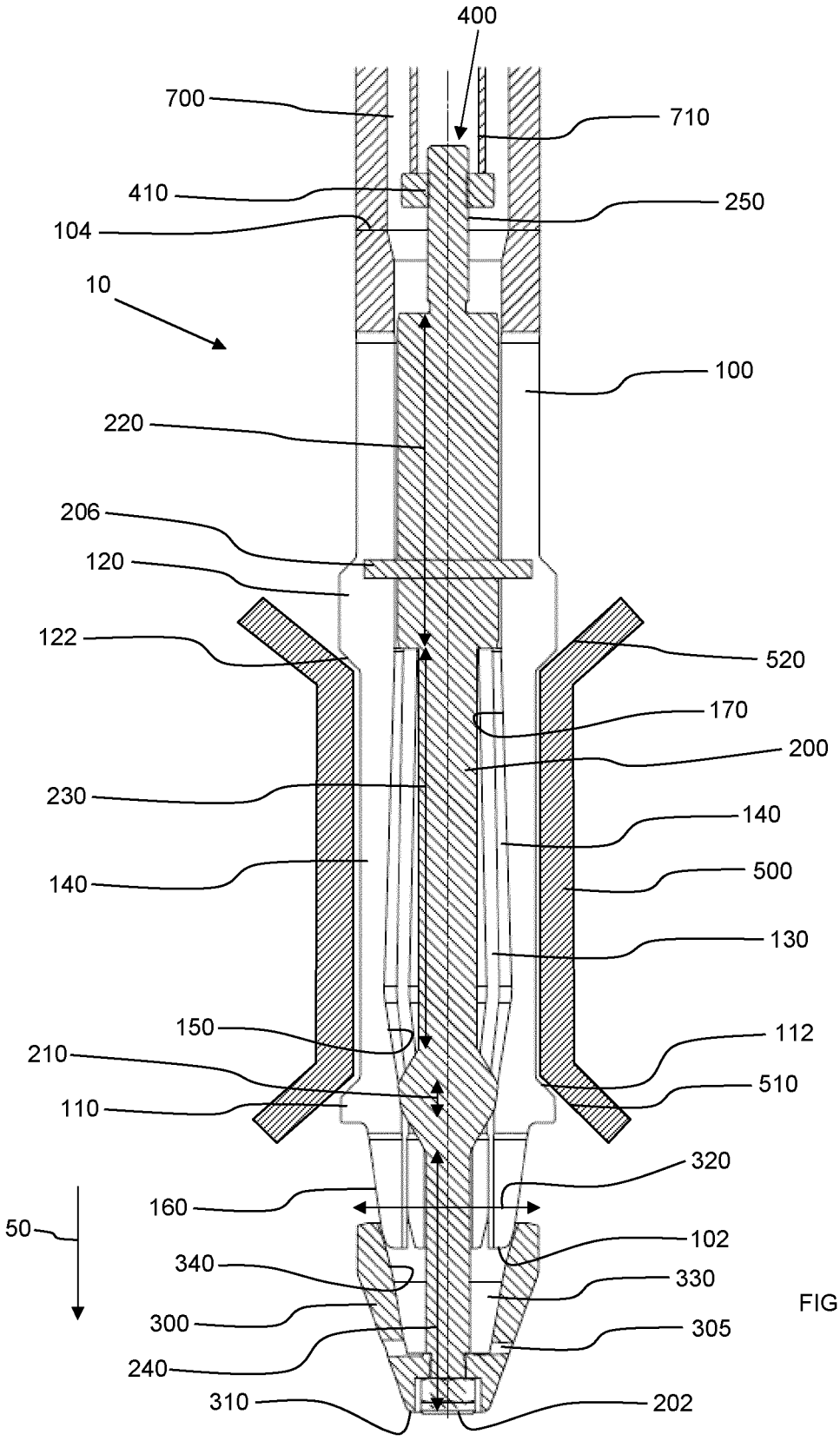
FIG. 3 is a diagrammatic illustration along an axial cut of the exemplary embodiment of the guide rod according to FIG. 1.
Figure 4:
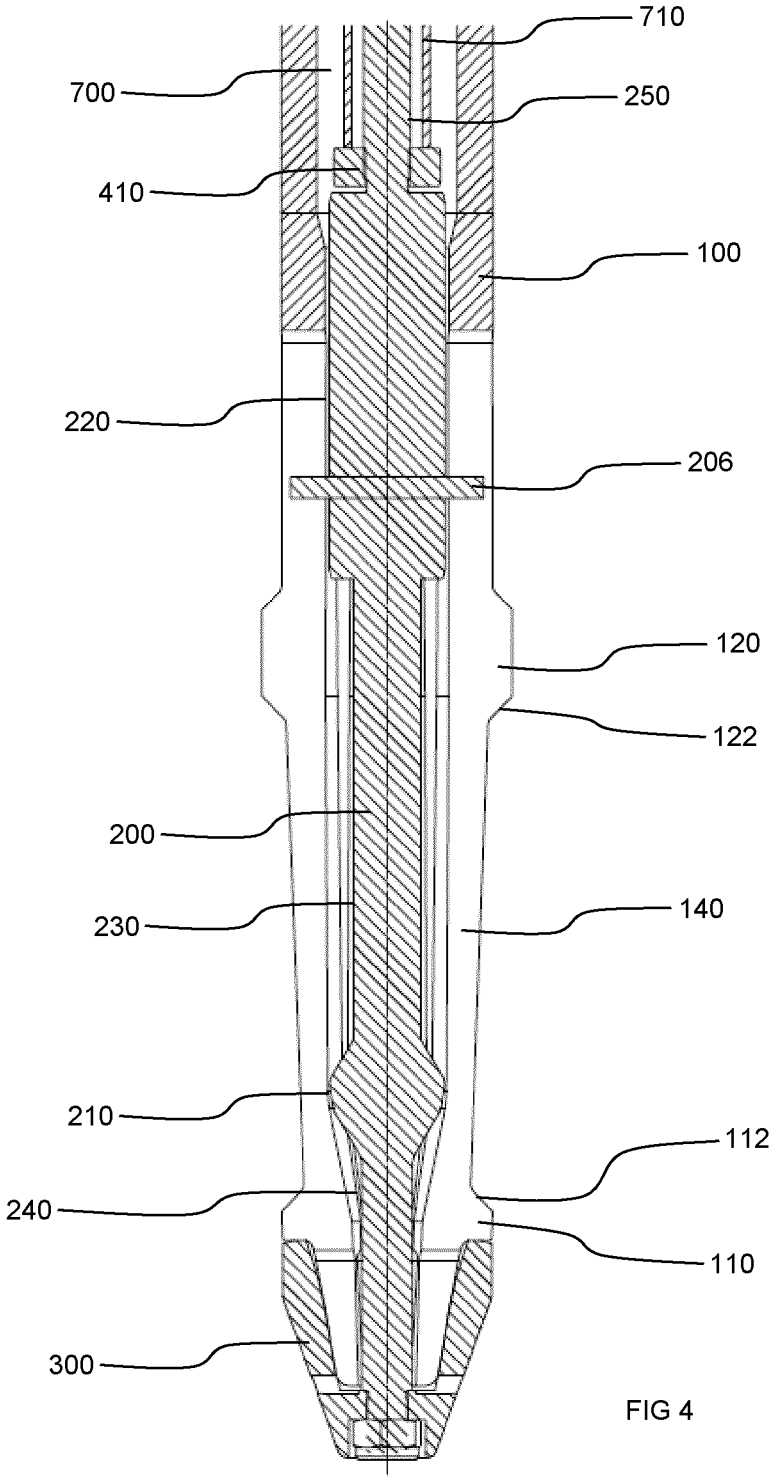
FIG. 4 is a diagrammatic illustration along an axial cut of the exemplary embodiment of the guide rod of FIG. 2.
Figure 5:
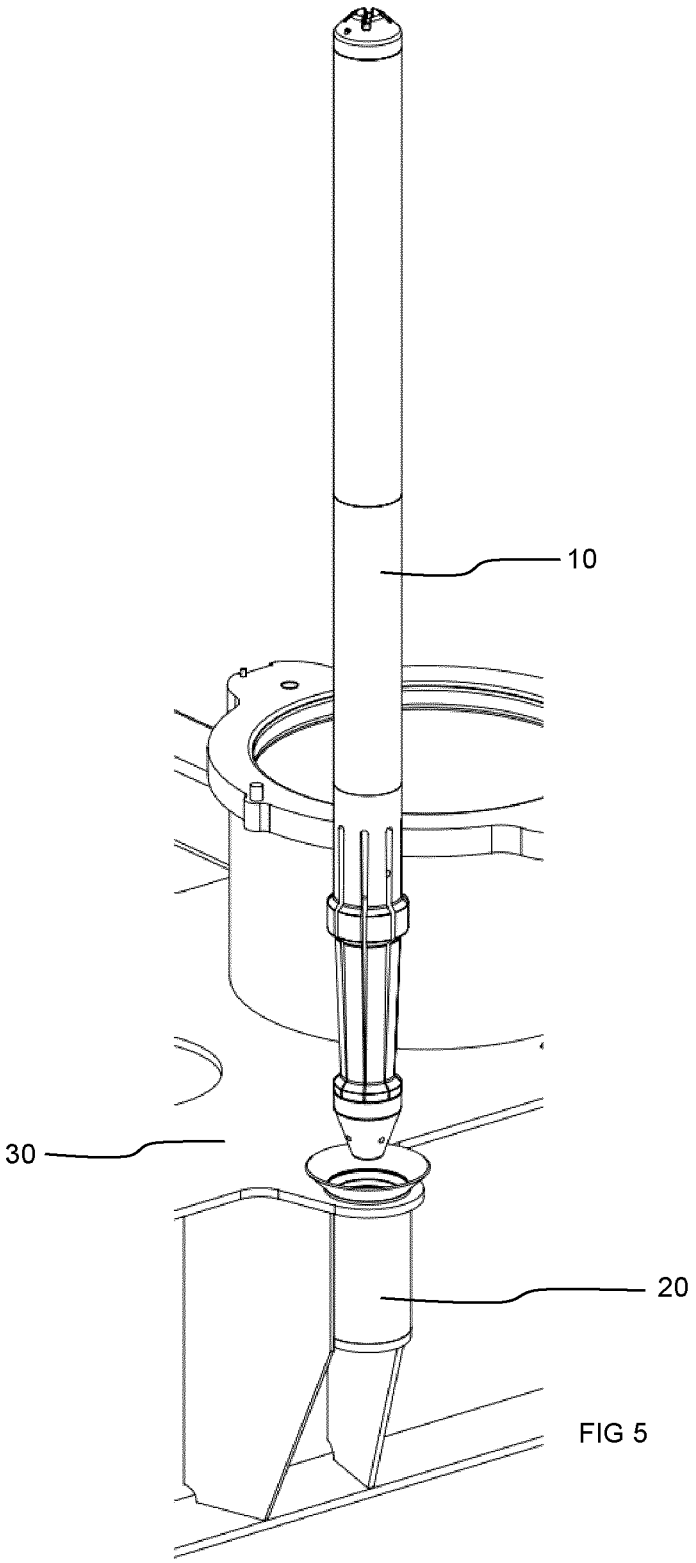
FIG. 5 is a diagrammatic illustration of an exemplary embodiment of a guide rod, a receptacle and a subsea component.

FIGS. 1 and 2 are diagrammatic illustrations of an exemplary embodiment of a guide rod. FIG. 1 illustrates the guide rod in its expanded state and FIG. 2 illustrates the guide rod in its contracted state. The contracted state is used when the guide rod is inserted into the receptacle, and once in the receptacle, the guide rod is expanded to lock into the receptacle. FIG. 3 illustrates a view taken along a cut along the axis of the guide rod in FIG. 1. FIG. 4 illustrates a view taken along a cut along the axis of the guide rod in FIG. 2. FIGS. 1 through 4 illustrate not the entire guide rod, just the front end, the lower end, of the guide rod that is to be placed into a receptacle.

According to one embodiment, a guide rod, for guiding two subsea components together is illustrated in FIGS. 1 through 4. The guide rod 10 is able to be both inserted and locked into a receptacle 20 on one 30 of the two subsea components. The guide rod comprises and element 100, a wedge 200, a cone 300, and a mechanism 400 for moving the wedge 200 axially relative to the element 100.

The element 100 is substantially hollow and cylindrical. The element 100 comprises a first circumferential shoulder 110 towards a first end 102, a second circumferential shoulder 120 towards an opposite second end 104, and a plurality of openings 130. Each opening 130 extends radially through the element 100 and extends axially along the element 100 opening up the element 100 from the first end 102 to, and including, the second circumferential shoulder 120. The plurality of openings 130 form elongate flexible sections 140 of the element 100. The plurality of openings 130 extend through the first circumferential shoulder 110. In some embodiments, the plurality of openings 130 start with a partly circular opening and extend in the axial direction through both the first and second circumferential shoulders 110 and 120 and extend in the axial direction along the rest of the element 100 in an insertion direction 50 of the guide rod 10. The plurality of openings 130 open up the first end 102 as illustrated in FIGS. 1 through 4.

The wedge 200 is inside the element 100 and the wedge 200 is substantially cylindrical. The wedge 200 comprises a cone shaped section 210. The wedge 200 is restricted from rotating relative to the element 100. The wedge 200 comprises an end 202, which is outside of the element 100. In some embodiments, the cone shaped section 210 is a truncated cone shaped section 210. For example, a pin 206 going through the centre of the wedge 200 extends into one, or two, of the plurality of opening 130, and in this way, the wedge 200 is restricted from rotating relative to the element 100.

The cone 300 is connected to the end 202 of the wedge 200. The cone 300 is cone shaped with a vertex 310 pointing away from the element 100. That is, the pointed top of the cone points in the insertion direction 50, and the base of the cone 300 faces the element 100.

The mechanism 400 is for moving the wedge 200 axially relative to the element 100 in the insertion direction 50, and opposite the insertion direction 50, of the guide rod 10. That is, the mechanism 400 can move the wedge 200 axially relative to the element 100 to the left and to the right in FIGS. 1-4. This will, as further explained below, move the flexible sections 140 inwards so that the guide rod may be inserted into a receptacle, and move the flexible sections 140 outwards so that the guide rod 10 may be locked in the receptacle 20.

According to one embodiment, the mechanism 400 is configured to move the wedge 200 in the insertion direction 50 and thereby move the cone 300 in the insertion direction 50 and at the same time move the elongate flexible sections 140 outward with the wedge 200. In this way, the mechanism 400 locks the guide rod 10 into the receptacle 20. In this position, the elongate flexible sections 140 are in their outmost position, as illustrated in FIGS. 1 and 3. In further embodiments, the mechanism 400 is also configured to move the wedge 200 opposite the insertion direction 50 and thereby move the cone 300 towards and over at least a part of the elongate flexible sections 140 thereby forcing the elongate flexible sections 140 inwards, together, and at the same time move the wedge 200 to allow the elongate flexible sections 140 to move inwards, together. In this way, the mechanism 400 reduces the diameter of the end of the guide rod 10 so that it can enter the receptacle 20. In this position, the elongate flexible sections 140 are in their innermost position, as illustrated in FIGS. 2 and 4.

According to one embodiment, the element 100 is configured to have no internal stress when the elongate flexible sections 140 have been moved to their outmost position with the wedge 200. This outmost position is the end position, the position where the guide rod 10 is locked with the receptacle 20. This position is illustrated in FIGS. 1 and 3. At this position, the element 100 has no internal stress, it has no load and no internal load or pressure. When the guide rod 10 is locked in the receptacle 20, then there is no load on the element 100. The element 100, the elongate flexible sections 140, just closes any gaps between the element 100 and the receptacle 20. In embodiments, the fit of the guide rod in the receptacle is a location fit, or a transition fit, according to the ISO standard of engineering fits. That is, the receptacle is fractionally smaller than the element 100 of the guide rod and mild force may exist between the two. The standard tolerance between the two may for example be H7/h6, K7/h6, H7/n6, and/or N7/h6. In embodiments, the element 100 is locked into the receptacle 20 to eliminate any space between the two without stress. In embodiments, the element 100 is held nominally in the receptacle 20. However, because of any tolerances between the two there may be some minor stress, but this would not be any significant stress to consider. This allows the locked in guide rod to take up extra large forces, and transfer these forces to the ground, rather than the wellhead.

According to one embodiment, the wedge 200 is pushed to put some stress on the elongate flexible sections 140. In embodiments, the wedge 200 is pushed downwards, towards the cone 300, just a bit to eliminate any space between the elongate flexible sections 140 and the receptacle 20. In this case, there is no significant stress between the two. This kind of locking allows the guide rod to take up large forces when later guiding a subsea component. For example, the guide rod supports and guides a BOP onto a wellhead and the forces, for example the forces when the BOP locks onto the guide rod, is then transferred into the foundation and the bottom of the sea, instead of to the wellhead. In other embodiments, the wedge 200 is pushed downwards with some force to create contact stress between the element 100 and the receptacle 20.

According to one embodiment, the element 100 comprises an inner cone shaped surface 150, an outer cone shaped surface 160, and an inner straight section 170. In embodiments, the outer cone shaped surface 160 is at the first end 102 of the element 100 facing the direction of insertion 50. In embodiments, the inner straight section 170 is at, towards, the second end 104 of the element 100. The inner cone shaped surface 150 is, when viewed in the axial direction, between the outer cone shaped surface 160 and the inner straight section 170. This is best illustrated in FIGS. 3 and 4.

According to one embodiment, the first circumferential shoulder 110 comprises a first truncated cone shaped surface 112, and the second circumferential shoulder 120 comprises a second truncated cone shaped surface 122. In embodiments, the first truncated cone shaped surface 112 and the second truncated cone shaped surface 122 face each other. This may best be taken from FIGS. 1 through 4. In embodiments, the first truncated cone shaped surface 112 and the second truncated cone shaped surface 122 is circumferential. In embodiments, the plurality of openings 130 extend through both the truncated cone shaped surfaces 112 and 122. In embodiments, the plurality of openings 130 start in the second truncated cone shaped surface 122 and extend through the first truncated cone shaped surfaces 112 to the first end 102. In this way, the second truncated cone shaped surface 122 lands on the receptacle 20 and the first truncated cone shaped surface 112 is enlarged, or reduced, circumferentially and radially, to allow the guide rod to be locked into the receptacle 20.

According to one embodiment, the cone 300 comprises a hollow space 330 for at least a part of the elongate flexible sections 140 of the element 100. In embodiments, the cone 300 comprises an inner cone shaped surface 340 that is always around at least a part of the elongate flexible sections 140, when view in the radial direction. This allows the inner cone shaped surface 340 to force the elongate flexible sections 140 together in the hollow space 330. When the cone 300 is pulled in the opposite direction of the insertion direction 50 by the mechanism 400, then the inner cone shaped surface 340 engages the ends of the elongate flexible sections 140 and forces them to move inwards, together. When doing so, stress is put onto the elongate flexible sections 140. A base 320 of the cone 300 has a diameter that is smaller than a largest diameter of the element 100. This allows the cone 300 to easily enter the receptacle 20 and guide the guide rod 10 with the element 100 into the receptacle 20. In embodiments, the cone 300 is a right circular cone, a truncated cone, a frustum, and/or a hollow cone.

According to one embodiment, the mechanism 400 comprises an internal thread 410 interacting with an external thread 250 on the wedge 200. In embodiments, the mechanism 400 comprises an internal thread 410 interacting with an external thread 250 connected to the wedge 200. In embodiments, the mechanism 400, for example, comprises a saddle nut around a threaded spindle on, or connected to, the wedge 200. In embodiments, the mechanism comprises an electric motor. In embodiments, an external connection is made for providing rotational movement to the mechanism 400.

According to one embodiment, the wedge 200 comprises a straight section 220, a middle section 230, the cone shaped section 210, and an end section 240. In embodiments, a diameter of the straight section 220 is constant and is larger than a diameter of the middle section 230. In embodiments, the diameter of the middle section 230 is larger than a diameter of the end section 240. In embodiments, the cone shaped section 210 has a base diameter that corresponds to the diameter of the middle section 230 and a vertex diameter that corresponds to the diameter of the end section 240. In embodiments, the end section 240 comprises the end 202 of the wedge 200. This is best illustrated in FIGS. 3 and 4.

According to one embodiment, the plurality of openings extend axially along the element 100 from the first end 102, through the first circumferential shoulder 110, through the second circumferential shoulder 120, and beyond the second circumferential shoulder 120. In this way, the element 100 allows the elongate flexible sections 140 of the element 100 to be moved inwards together by the cone 300, as well as be moved outwards by the wedge 200.

According to one embodiment, a cover is arranged on the cone 300 to prevent dirt from entering into the cone 300. In embodiments, the cover 300 extends from the cone 300 to the element 100. In embodiments, the cover is circumferentially around the guide rod. In embodiments, the cover covers the entire cone 300 and only parts of the element 100. In embodiments, the cover prevents dirt, such as mud, from entering into the hollow cone and thereby prevent that the ends of the elongate flexible sections 140 can move inwards, together.

According to one embodiment, the cone 300 comprises a cone opening 305, or a plurality of cone openings 305. In embodiments, the cone opening 305 is close to the vertex 310 of the cone. In embodiments, the cone opening 305 allow matters, for example dirt, that entered the cone 300 to escape the cone 300 through the cone opening 305.

According to one embodiment, the guide rod further comprises an elongate guiding member 700. In embodiments, the guiding member 700 is hollow with a drive shaft 710 inside for the mechanism 400. In embodiments, the guide member 700 is part of the element 100. In embodiments, the guide member 700 is axially connected to the element 100. In this way, the mechanism 400 is activated from the axial end opposite the insertion direction of the guide rod by, for example, turning the drive shaft 710 inside the guide member 700 and thereby rotating the mechanism 400 and moving the wedge 200 relative to the element 100 and the guide member 700.

According to one embodiment, there are eight openings 130 and eight flexible sections 140. Having eight openings 130 provides a reliable movement of the flexible sections 140, while at the same time providing a reliable and robust hold of the guide rod in the receptacle when the flexible sections 140 are extended in the receptacle. An embodiment with six or seven or nine openings 130 and respective six or seven or nine flexible sections 140 would also be adequate.

According to one embodiment, each of the plurality of openings 130 has a width, in the circumferential direction, that is configured such that the final position of moving the flexible sections 140 together by the cone 300 still allows for a space between the flexible sections 140. In embodiments, the element 100, the wedge 200 and the cone 300 are made out of metal.

According to one embodiment, the plurality of the flexible sections 140 of the element 100 move from a contracted position where the flexible sections 140 are held together by the cone 300, for being inserted into the receptacle 20, to an outer position where the flexible sections 140 are held outwards and stress free by the wedge 200. In embodiments, the diameter of the first circumferential shoulder 110 in the outer position is about 110 to 125 percent of the diameter of the first circumferential shoulder 110 in the contracted position. In another embodiment, the diameter of the first circumferential shoulder 110 in the outer position is about 116 to 118 percent of the diameter of the first circumferential shoulder 110 in the contracted position.

According to one embodiment, the first circumferential shoulder 110 of the element 100 is radially within the inner cone shaped surface 150 of the element 100. In this way, the guide rod is able to take up large forces. In addition, or separately, according to one embodiment, the circumferential shoulder 120 of the element 100 is radially within the straight section 220 of the wedge 200, when the wedge is in its end position towards the insertion direction, i.e., in the position where the guide rod 10 is locked into the receptacle 20. In this way, the guide rod is able to take up large forces.

According to one embodiment, the pin 206 going through the centre of the wedge 200 extends into three or four of the plurality of opening 130. In embodiments, the pin 206 takes up less than half the width in one of the plurality of opening 130. In embodiments, the pin 206 is positioned closer to the second circumferential shoulder 120 than to the first circumferential shoulder 110, in one of the plurality of opening 130. In this way, the pin 206 does not interfere when the wedge 200 moves the flexible sections 140 together.

According to one embodiment, a subsea component comprises the guide rod 10 according to any one of the preceding embodiments. In embodiments, the subsea component is a wellhead where the guide rod has been placed into a receptacle of the wellhead. In embodiments, the subsea component is a remotely operated vehicle (ROV) that installs a guide rod.

According to one embodiment, a combination of the guide rod 10, according to any one of the preceding embodiments of the guide rod, and the receptacle 20, on one 30 of the two subsea components, is disclosed. The receptacle 20 comprises a substantially hollow cylinder 500 with a first circumferential shoulder 510 of the receptacle 20 and a second circumferential shoulder 520 of the receptacle 20. The first circumferential shoulder 510 of the receptacle 20 and the second circumferential shoulder 520 of the receptacle 20 are complementary in shape to engage the first circumferential shoulder 110 and the second circumferential shoulder 120, respectively. The second circumferential shoulder 520 of the receptacle 20 engages the second circumferential shoulder 120 when the guide rod 10 lands on the receptacle 20. The first circumferential shoulder 510 of the receptacle 20 engages the first circumferential shoulder 110 when the elongate flexible sections 140 are extended into the outward position by the movement of the wedge 200. An inner diameter of the hollow cylinder 500 is smaller than an outer diameter of the second circumferential shoulder 120.

According to one embodiment, the hollow cylinder 500, the first circumferential shoulder 510 of the receptacle 20, and the second circumferential shoulder 520 of the receptacle 20 are fitted in form to the element 100 with the first circumferential shoulder 110 and the second circumferential shoulder 120. Fitted in form means that their shapes are complementary in form, designed to fit snugly to each other. In embodiments, the hollow cylinder 500, the first circumferential shoulder 510 of the receptacle 20, and the second circumferential shoulder 520 of the receptacle 20 are close fitted in form to the element 100 with the first circumferential shoulder 110 and the second circumferential shoulder 120.

According to one embodiment, the combination is configured such that when the guide rod 10 is locked in the receptacle 20 then there is no clearance between the two. The guide rod 10 and the receptacle 20 are complementary in form, designed to fit each other snugly, such that there is no clearance, no space, between them.

According to one embodiment, the combination is configured such that when the guide rod 10 is locked in the receptacle 20 then the element 100 and the receptacle are free from stress from each other due to the locking. When the guide rod 10 is held in the receptacle 20 then there is no clamping force between them because the guide rod 10 is being held in the receptacle 20. Forces may be put onto the combination of the guide rod 10 and the receptacle 20 from the outside, but the locking of the guide rod 10 into the receptacle 20 creates no forces or stress on the guide rod 10 or on the receptacle 20. This allows the guide rod 10 and the receptacle 20 to take up large external forces.

According to one embodiment, the element 100, the wedge 200, and the cone 300 are all arranged co-axially. In a further embodiment, the mechanism 400 is also arranged co-axially. In embodiments, the cone 300 is only connected to the end 202 of the wedge 200. In embodiments, the cone is connected to rotate together with the wedge 200, or connected to not rotate with the wedge 200.

According to one embodiment, the element 100 according to any one of the preceding embodiment has an axial length measured between the second circumferential shoulder 120 and the first end 102 that is between two to four times the diameter of the second circumferential shoulder 120. In other embodiments, the range one and a half to five times would also work.

The guide rod according to one or more embodiments as described above is able to take up large forces. The locking of the guide rod 10 to the receptacle 20 does not create, transmit, large forces to the receptacle 20 due to the features of the locking mechanism. By having the elongate flexible sections 140 in their neutral state, without stress, during locking and rather temporarily deform during insertion into the receptacle 20, the least amount of stresses are applied on the locked guide rod 10 by the locking itself. One or more embodiments disclosed herein provide guide rods 10 that are able to be locked into receptacles 20 that are on the foundation for the wellhead. Guiding the BOP onto the wellhead using such guide rods would allow the BOP to be able to lock relative the guide rods when in position, thereby also supporting the BOP. At least an amount of the forces from the BOP, created due to external influence on the BOP, would therefore have the possibility to go through the foundation and into the ground and not affect the wellhead.

It will be apparent to those skilled in the art that various modifications and variations can be made to the system and method for remote operation of a well equipment through a marine riser. Other embodiments will be apparent to those skilled in the art from consideration of the specification and practice of the disclosed nipple. It is intended that the specification and examples be considered as exemplary only, with a true scope being indicated by the following claims and their equivalents.

LIST OF ELEMENTS

10 guide rod
20 receptacle
30 one of two subsea components
50 insertion direction
100 element
102 first end, of the element
104 opposite second end, of the element
110 first circumferential shoulder
112 first truncated cone shaped surface
120 second circumferential shoulder
122 second truncated cone shaped surface
130 plurality of openings
140 elongate flexible sections
150 inner cone shaped surface, of the element
160 outer cone shaped surface, of the element
170 inner straight section, of the element
200 wedge
202 end, of the wedge
210 cone shaped section, of the wedge
220 straight section, of the wedge
230 middle section, of the wedge
240 end section, of the wedge
250 external thread
300 cone
305 cone opening
310 vertex, of the cone
320 base, of the cone
330 hollow space, of the cone
340 inner cone shaped surface, of the cone
400 mechanism
410 internal thread
500 hollow cylinder
510 first circumferential shoulder, of the receptacle
520 second circumferential shoulder, of the receptacle

The invention claimed is:

1. A guide rod for guiding two subsea components together, the guide rod configured to be both inserted and locked into a receptacle on one of two subsea components, the guide rod comprising:

an element, the element being substantially hollow and cylindrical, the element including a first circumferential shoulder towards a first end, a second circumferential shoulder towards an opposite second end, and a plurality of openings, each opening extending radially through the element and extending axially along the element opening up the element from the first end to at least the second circumferential shoulder, the plurality of openings forming elongate flexible sections of the element, and extending through the first circumferential shoulder, the first circumferential shoulder further comprising a first truncated cone shaped surface, the second circumferential shoulder comprising a second truncated cone shaped surface, the first truncated cone shaped surface and the second truncated cone shaped surface facing each other;

a wedge located inside the element, the wedge being substantially cylindrical and comprising a cone shaped section, the wedge restricted from rotating relative to the element, the wedge including an end being outside of the element, the wedge configured to move axially relative to the element; and a cone coupled to the end of the wedge, the cone being cone shaped with a vertex pointing away from the element, the cone defining a hollow space for at least a part of the elongate flexible sections of the element.

2. The guide rod according to claim 1, wherein a mechanism is configured to move the wedge in an insertion direction and thereby move the cone in the insertion direction and at the same time move the elongate flexible sections outward with the wedge; and wherein the mechanism is configured to move the wedge opposite the insertion direction and thereby move the cone towards and over at least a part of the elongate flexible sections thereby forcing the elongate flexible sections inwards and at the same time move the wedge to allow the elongate flexible sections to move inwards.

3. The guide rod according to claim 2, wherein the element is configured to have no internal stress when the elongate flexible sections have been moved to their outmost position with the wedge.

4. The guide rod according to claim 1, wherein the element further comprises an inner cone shaped surface, an outer cone shaped surface, and an inner straight section; and wherein the outer cone shaped surface is at the first end of the element facing a direction of insertion, the inner straight section is towards the second end of the element, and the inner cone shaped surface is, viewed in the axial direction, between the outer cone shaped surface and the inner straight section.

5. The guide rod according to claim 1, wherein the cone further comprises an inner cone shaped surface that is always around at least a part of the elongate flexible sections to allow the inner cone shaped surface to force the elongate flexible sections together in the hollow space; and wherein a base of the cone has a diameter that is smaller than a largest diameter of the element.

6. The guide rod according to claim 2, further comprising a mechanism including an internal thread interacting with an external thread on, or connected to, the wedge.

7. The guide rod according to claim 1, wherein the wedge comprises a straight section, a middle section, the cone shaped section, and an end section.

8. The guide rod according to claim 7, wherein a diameter of the straight section is constant and is larger than a diameter of the middle section.

9. The guide rod according to claim 7, wherein the diameter of the middle section is larger than a diameter of the end section;

wherein the cone shaped section has a base diameter that corresponds to the diameter of the middle section and a vertex diameter that corresponds to the diameter of the end section; and wherein the end section comprises the end of the wedge.

10. The guide rod according to claim 1, wherein the plurality of openings extend axially along the element from the first end, through the first circumferential shoulder, through the second circumferential shoulder, and beyond the second circumferential shoulder.

11. The guide rod according to claim 1, wherein a cover is arranged on the cone to prevent debris from entering into the cone.

12. The guide rod according to claim 2, wherein the guide rod further comprises an elongate guiding member, the guiding member being hollow with a drive shaft inside for the mechanism and the guide member being part of, or axially connected to, the element.

13. The guide rod according to claim 1, wherein the first circumferential shoulder and the second circumferential shoulder of the element are complementary in shape to engage a first circumferential shoulder and a second circumferential shoulder of the receptacle.

14. The guide rod according to claim 13, wherein an inner diameter of a hollow cylinder of the receptacle is smaller than an outer diameter of the second circumferential shoulder.

15. The guide rod according to claim 14, wherein the hollow cylinder, the first circumferential shoulder of the receptacle, and the second circumferential shoulder of the receptacle are fitting in form to the element with the first circumferential should and the second circumferential shoulder of the element.

16. The guide rod according to claim 14, wherein, when the guide rod is locked in the receptacle, there is no clearance between the two.

17. The guide rod according to claim 14, wherein, when the guide rod is locked in the receptacle, the element and the receptacle are free from stress from each other due to the locking.

18. A guide rod for guiding two subsea components together, the guide rod configured to be both inserted and locked into a receptacle on one of two subsea components, the guide rod comprising:

an element, the element being substantially hollow and cylindrical, the element including a first circumferential shoulder towards a first end, a second circumferential shoulder towards an opposite second end, and a plurality of openings, each opening extending radially through the element and extending axially along the element opening up the element from the first end to at least the second circumferential shoulder, the plurality of openings forming elongate flexible sections of the element, and extending through the first circumferential shoulder, the first circumferential shoulder further comprising a first truncated cone shaped surface, the second circumferential shoulder comprising a second truncated cone shaped surface, the first truncated cone shaped surface and the second truncated cone shaped surface facing each other;

a wedge located inside the element, the wedge being substantially cylindrical and comprising a cone shaped section, the wedge restricted from rotating relative to the element, the wedge including an end being outside of the element, the wedge configured to move axially relative to the element;

an electric motor coupled to the wedge for moving the wedge axially relative to the element; and a cone coupled to the end of the wedge, the cone being cone shaped with a vertex pointing away from the element, the cone defining a hollow space for at least a part of the elongate flexible sections of the element.

19. A guide rod for guiding two subsea components together, the guide rod configured to be both inserted and locked into a receptacle on one of two subsea components, the guide rod comprising:

an element, the element being substantially hollow and cylindrical, the element including a first circumferential shoulder towards a first end, a second circumferential shoulder towards an opposite second end, and a plurality of openings, each opening extending radially through the element and extending axially along the element opening up the element from the first end to at least the second circumferential shoulder, the plurality of openings forming elongate flexible sections of the element, and extending through the first circumferential shoulder, the first circumferential shoulder further comprising a first truncated cone shaped surface, the second circumferential shoulder comprising a second truncated cone shaped surface, the first truncated cone shaped surface and the second truncated cone shaped surface facing each other;

a wedge located inside the element, the wedge being substantially cylindrical and comprising a cone shaped section, the wedge restricted from rotating relative to the element, the wedge including an end being outside of the element, the wedge configured to move axially relative to the element, the wedge having an external thread;

a mechanism coupled to the wedge to axially move the wedge relative to the element, the mechanism including an electric motor that drives the wedge to move axially relative to the element, the mechanism including an internal thread that couples to the external thread of the wedge; and a cone coupled to the end of the wedge, the cone being cone shaped with a vertex pointing away from the element, the cone defining a hollow space for at least a part of the elongate flexible sections of the element.

* * * * *